US010062951B2

(12) United States Patent
Daniel et al.

(10) Patent No.: US 10,062,951 B2
(45) Date of Patent: Aug. 28, 2018

(54) DEPLOYABLE PHASED ARRAY ANTENNA ASSEMBLY

(71) Applicant: Palo Alto Research Center Incorporated, Palo Alto, CA (US)

(72) Inventors: George Daniel, Palo Alto, CA (US); Victor Liu, Mountain View, CA (US); Armin R. Volkel, Mountain View, CA (US); Bernard D. Casse, Saratoga, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 47 days.

(21) Appl. No.: 15/066,593

(22) Filed: Mar. 10, 2016

(65) Prior Publication Data

US 2017/0263997 A1 Sep. 14, 2017

(51) Int. Cl.
*H01Q 1/08* (2006.01)
*H01Q 3/00* (2006.01)
(Continued)

(52) U.S. Cl.
CPC ..... *H01Q 1/08* (2013.01); *H01Q 1/362* (2013.01); *H01Q 3/00* (2013.01); *H01Q 23/00* (2013.01)

(58) Field of Classification Search
CPC ..... H01Q 1/08; H01Q 1/362; H01Q 3/00; H01Q 23/00
(Continued)

(56) References Cited

U.S. PATENT DOCUMENTS 5,138,331 A * 8/1992 Josypenko ..... H01Q 11/08 343/853
5,450,093 A * 9/1995 Kim ..... H01Q 11/08 343/853
(Continued)

FOREIGN PATENT DOCUMENTS

WO 200143228 A 6/2001

OTHER PUBLICATIONS

Kohmura et al. "Land Mobile Satellite Communication System Using the Geostationary Platform, Journal of Spacecraft and Rockets vol. 30, No. 2, Mar.-Apr. 1993."*
(Continued)

*Primary Examiner* — Dieu H Duong
*Assistant Examiner* — Bamidele A Jegede
(74) *Attorney, Agent, or Firm* — Bever, Hoffman & Harms, LLP

(57) ABSTRACT

A lightweight deployable antenna assembly for, e.g., microsatellites including multifilar (e.g., quadrifilar) antenna (MHA) structures rigidly maintained in an array pattern by a lightweight linkage and collectively controlled by a central antenna feed circuit and local antenna feed circuits to perform phased array antenna operations. The linkage is preferably an expandable (e.g., flexural-scissor-grid) linkage capable of collapsing into a retracted/stowage state in which the MHA elements are maintained in a closely-spaced (e.g., hexagonal lattice close-packed) configuration optimized for payload storage. To deploy the antenna for operation, the linkage unfolds (expands) such that the MHA elements are moved away from each other and into an evenly spaced (e.g., wide-spaced hexagonal) pattern optimized for phased array operations. The MHA structures utilize modified helical filar elements including metal plated/printed on polymer/plastic beams/ribbons, or thin-walled metal tubes. The heli-
(Continued)

cal filar elements are radially offset (e.g., by 90°) and wound around a central axis.

20 Claims, 8 Drawing Sheets

(51) Int. Cl.
*H01Q 1/36* (2006.01)
*H01Q 23/00* (2006.01)

(58) Field of Classification Search
USPC ..... 343/881
See application file for complete search history.

(56) References Cited

U.S. PATENT DOCUMENTS 5,680,145 A * 10/1997 Thomson ..... F24J 2/125 343/840
5,909,197 A * 6/1999 Heinemann ..... H01Q 1/1235 343/880
5,920,292 A * 7/1999 O'Neill, Jr. ..... H01Q 1/242 343/702
5,931,420 A * 8/1999 Yamato ..... B64G 1/222 244/159.5
6,028,570 A * 2/2000 Gilger ..... H01Q 1/288 343/880
6,285,340 B1 * 9/2001 Park ..... H01Q 1/244 343/702
6,504,516 B1 * 1/2003 Davis ..... H01Q 3/26 342/368
6,552,695 B1 * 4/2003 Strickland ..... H01Q 1/362 343/895
6,819,302 B2 * 11/2004 Volman ..... H01Q 1/525 343/702
7,002,517 B2 2/2006 Noujeim
2003/0164805 A1 * 9/2003 Strickland ..... H01Q 21/067 343/895
2004/0008153 A1 * 1/2004 Lamensdorf ..... H01Q 1/362 343/895
2004/0135736 A1 * 7/2004 Fund ..... H01Q 3/2682 343/895
2014/0266946 A1 9/2014 Billy et al.
2014/0300520 A1 10/2014 Nguyen et al.
2015/0229028 A1 8/2015 Billy et al.
2015/0318618 A1 11/2015 Chen et al.
2015/0372389 A1 12/2015 Chen et al.

OTHER PUBLICATIONS

Ebisui et al. "Characteristics of Large Deployable Mesh Reflector Antennas for Future Mobile Communications Satellites, 1992 American Institute of Aeronautics and Astronautics, Inc."*

* cited by examiner

DEPLOYABLE PHASED ARRAY ANTENNA ASSEMBLY

FIELD OF THE INVENTION

This invention relates to deployable antennas, and more particularly to deployable high-gain, high efficiency antenna having a lightweight architecture suitable for use on microsatellite platforms.

BACKGROUND OF THE INVENTION

Compact, extremely lightweight, deployable RF antennas are key to enabling state-of-the-art RF communications and sensing on a microsatellite platform. Deploying a highly compacted, electronically functioning antenna to the required rigidity, size, and pointing accuracy is an extremely challenging problem. Though considerable effort has been invested in the development of deployable structures and antennas, there is currently no fully functional deployable antenna that is compatible with microsatellite platforms. For example, although large reflector antennas achieve suitable gain (dBi) values, they exhibit very low antenna efficiency and require very large physical antenna areas that are heavy and difficult to transport and deploy. Inflatable reflective array antennas and waveguide array antennas require substantially smaller physical antenna areas, but exhibit lower gain values and only slightly higher antenna efficiencies. Inflatable passive array antennas also have small physical antenna areas and achieve higher antenna efficiencies, but have low gain values and difficulty holding tight dimensional tolerances.

What is needed is a deployable high-gain, high efficiency antenna having a lightweight architecture optimized for use on microsatellite platforms that overcomes the problems associated with conventional deployable antenna solutions.

SUMMARY OF THE INVENTION

The present invention is directed to an antenna assembly including an array of multifilar (e.g., quadrifilar, hexifilar or octofilar) helix antenna (MHA) structures that are rigidly maintained in an optimal (e.g., hexagonal) phased array configuration by a lightweight linkage, and are controlled by a central antenna feed circuit such that the MHA structures collectively perform phased array antenna operations capable of maintaining a circularly polarized radiation pattern while requiring an approximately four-times (4×) smaller physical area than an equal gain aperture-type antenna (e.g., parabolic dish). Each MHA structure includes multiple (e.g., four, six or eight) helical filar elements disposed in a spaced-apart relationship around a central axis (i.e., disposed within an elongated cylindrical volume), with each helical filar element coupled by way of intervening electronics to the central antenna feed circuit, which in turn is configured to transmit signals to and receive signals from the multiple helical filar elements in accordance with known phased array operating practices. The lightweight linkage includes several support structures connected by bar-like linkage elements, and a fixed end of each MHA structure is fixedly connected to one of the support structures such that all of the MHA structures extend parallel to each other from the linkage. The resulting phased array antenna assembly achieves a highly-directive beam at higher gain values (43.4 dBi or greater) and higher aperture (antenna) efficiencies (i.e., 92% or greater) than conventional deployable antenna approaches by multiplying the gain of each MHA structure by the number of MHA structures in the array. Moreover, by rigidly arranging the MHA structures in an optimal array configuration (pattern), phased array antenna assemblies produced in accordance with the present invention achieve an equivalent effective antenna area (EFA; i.e., target antenna area) consistent with conventional antennas requiring four times the physical area. Further, each MHA structure utilizes multiple helical elements to generate a single forward lobe, which obviates the need for a dedicated ground plane structure required by single helical and other antenna topologies, whereby phased array antenna assemblies produced in accordance with the present invention have a significant weight and space advantage over conventional deployable antenna approaches. Accordingly, by utilizing an array of MHA structures, a lightweight linkage and the central antenna feed circuit discussed above, the present invention facilitates the production of high-gain, high-efficiency phased array antenna assemblies exhibiting highly accurate beam pointing capabilities that are difficult to achieve using conventional antenna approaches, and also have lightweight architectures and scalable footprints that can be optimized for use on a wide range of microsatellite platforms.

According to a presently preferred embodiment, each MHA structure includes helical filar elements that are modified to minimize weight and to enable phased array operations, whereby the MHA structures are further optimized for microsatellite platforms. In a first specific embodiment, each of the helical filar elements utilized by the MHA structures is produced by disposing (e.g., plating or printing) a metal or other conductive material on a lightweight base structure (e.g., a liquid crystal polymer core or a flexible plastic substrate), and then bending the composite structure into the required helical shape. In a second specific embodiment, each of the four helical filar elements includes a thin-walled cylindrical metal (e.g., aluminum) tube surrounding a central vacuum air-filled void that is bent into the required helical configuration. Both the first and second specific embodiments provide helical filar elements having substantially lower weight/mass values than solid wire filars used by conventional single filar and multiple filar antennas. In another embodiment, each MHA structure further includes two lightweight (e.g., plastic or polymer) spacers respectively secure opposite (i.e., fixed and free) ends of the helical filar elements, and a local feed circuit board that is fixedly attached to the spacer connected to the fixed end of each helical filar element. The spacers are configured to secure and maintain the helical filar elements in a spaced-apart relationship such that the helical filar elements are reliably offset by common (i.e., equal or uniform) radial distances (e.g., 90°, 60° or 45°, depending on the number of elements) relative to the central axis, thereby facilitating low-cost assembly. The local feed circuit board is electrically connected to the helical filar elements of each M-QHA structure, and functions to coordinate the transmission of signals from the filar elements to the central antenna feed circuit in a manner described below. In an exemplary practical embodiment, each MHA element is a modified quadrifilar helix antenna (M-QHA) structure including four modified (lightweight) filar elements, but in other embodiments helical hexifilar or octofilar topologies may be utilized to increase gain and improve the compaction ratio.

According to another specific embodiment, the phased array antenna assemblies of the present invention include local antenna feed circuits that function in cooperation with the central antenna feed circuit to implement phased array operations. Each local antenna feed circuit is disposed adjacent to an associated said MHA structure (e.g., mounted on the support structure to which the associated MHA structure is connected) and electrically coupled between the central antenna feed circuit and the associated MHA structure's helical filar elements (e.g., by way of wires extending along the linkage elements and support structures of the linkage). In an exemplary embodiment, each local antenna feed circuit includes first and second hybrid couplers connected to each of four helical filar elements, and a third hybrid coupler coupled between the first and second hybrid couplers and an amplifier, which in turn is coupled to the central antenna feed circuit. With this arrangement, phased coupling of the four helical filar elements is controlled locally (i.e., by each local antenna feed circuit) in order to simplify operations of the central antenna feed circuit. In another exemplary embodiment, each local antenna feed circuit includes both a low-noise amplifier (e.g., a SiGe MMIC) for signal reception, and a power amplifier (e.g., a GaN HEMI) for signal transmission. To facilitate separate send and receive operating modes, a first (e.g., RF) switch is operably connected between the amplifiers and the third hybrid coupler, and a second switch is operably coupled between the amplifiers and the central antenna feed circuit. With this arrangement, the switches are configured to operably couple the low-noise amplifier between the central antenna feed circuit and the third hybrid coupler during each receive mode operating phase, and configured to couple the power amplifier between the central antenna feed circuit and the third hybrid coupler during each transmit mode operating phase, thereby facilitating phased array operations.

According to a presently preferred specific embodiment, the phased array antenna assembly is configured such that the MHA structures are disposed in a hexagonal pattern to provide optimal phased array operations. In an simplified exemplary embodiment, the phased array antenna assembly includes a total of seven MHA structures made up of six peripheral MHA structures disposed in a hexagonal pattern around a centrally disposed (first) MHA structure. With this basic arrangement, all six peripheral MHA structures are evenly spaced from two adjacent neighboring peripheral MHA structures and from the centrally disposed (first) MHA structure, thereby optimizing phased array operations. In practical embodiments, phased array antenna assemblies having larger numbers of MHA structures are formed by including additional peripheral MHA structures extending outward from the six peripheral MHA structures using the same linkage arrangement, whereby the phased array antenna assembly is easily scalable to provide a phased array having, for example, 55 or 115 MHA structures.

According to presently preferred embodiment, the phased array antenna assembly is further enhanced for use on microsatellite platforms by way of implementing the lightweight linkage using an expandable (e.g., flexural-scissor-grid) linkage that adjusts from a retracted state (stowage configuration) to an deployed state (expanded/operational configuration). When the expandable linkage is in its retracted state, the MHA structures are maintained in a closely-spaced parallel relationship (e.g., in a hexagonal close-pack arrangement with minimal spacing between adjacent MHA structures) such that the size (volume) of the phased array antenna assembly is optimally minimized for payload storage. During subsequent deployment, the expandable linkage is actuated (e.g., using force generated by a motor or spring) such that the support structures move away from each other to separation distances determined by the lengths of the intervening linkage elements, whereby the MHA structures are positioned and rigidly subsequently maintained in a spaced-apart parallel relationship (i.e., with a relatively large spacing between adjacent MHA structures) in an arrangement optimized for phased array operations. Once the MHA structures are deployed in this manner, the central antenna feed circuit initiates phased array operations by way of simultaneously controlling all of the MHA structures using signals passed, e.g., on wires mounted on the linkage elements of the expandable linkage. By utilizing an expandable linkage to deploy the array of MHA structures, phased array antenna assemblies produced in accordance with the present invention are further optimized for use by microsatellite platforms by way of exhibiting a compaction ratio (i.e., a ratio of the deployed state volume to the retracted state volume) of 60-to-1, 120-to-1 or higher, thereby minimizing valuable payload space and weight requirements, while also providing suitable rigidity and size/spacing characteristics in the deployed state that are optimized for reliable RF communications.

According to an aspect of the presently preferred embodiment, the expandable linkage is further configured to minimize payload space requirements and maximize phased array operations by way of maintaining the MHA structures in a coplanar relationship in both the retracted and deployed states. That is, the expandable linkage is configured such that the fixed ends of all of the MHA structures collectively define a relatively small (first) plane when the expandable linkage is in the retracted state, and such that the fixed ends of all of the MHA structures define a relatively large (second) plane when the expandable linkage is in the deployed (expanded) state. In an exemplary practical embodiment, this functionality is achieved using a flexure-scissor-grid linkage mechanism made up of vertical (parallel) slide rods that are operably mechanically coupled by intervening scissor units (linkage elements), where each scissor unit includes two bars connected at intermediate points by a pivot hinge. A central MHA structure is attached to a central slide rod by way of a first support structure, and six peripheral MHA structures are attached to six peripheral slide rods by way of associated support structures, with the six peripheral slide rods (and hence the six peripheral MHA structures) disposed in a hexagonal pattern around the central slide rod. To facilitate suitable expansion while limiting the overall length of the slide rods, six intermediate slide rods are disposed between the central slide rod and the six peripheral slide rods. Each scissor unit is connected between two adjacent associated slide rods, with the bars of each scissor unit pivotably attached at first (e.g., upper) ends to one of the associated slide rod, and pivotably and slidably attached (e.g., by way of a slide bearing) at a second (lower) ends to the second associated slide rod. To maintain the six peripheral MHA structures in the hexagonal pattern around the central MHA structure, six primary (innermost) scissor units are connected between the central slide rod and the six intermediate slide rods, and twelve secondary scissor units are connected between the six intermediate slide rods and the six peripheral slide rods, with each bar of each scissor unit is pivotably (non-slidably) attached at one end to a first associated slide rod, and is pivotably and slidably attached at its opposite end to an adjacent associated slide rod. With this arrangement, deployment is achieved by biasing the second (lower) ends of the six primary (innermost) scissor units upward along the central slide rod (e.g., by pulling the central slide rod downward using a spring or motor while preventing downward movement of the second (lower) ends), thereby causing the six primary (innermost) scissor units to pivot from an open position toward a closed position. The resulting radially outward movement of the six intermediate slide rods (i.e., away from the central slide rod) causes the twelve secondary scissor units to substantially simultaneously pivot toward the closed position, causing the six peripheral slide rods to also move radially outward from the central slide rod while maintaining the six peripheral MHA structures in the desired coplanar, hexagonal pattern relative to the central MHA structure. Another advantage provided by this scissor-grid linkage mechanism is that it is easily expandable (i.e., by way of mounting additional slide rods and additional scissor units to facilitate forming deployable phased array antenna assemblies having any number (e.g., 31, 55 or 115) MHA elements while maintaining the desired expandable coplanar relationship between the arrayed MHA elements.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in deployable antennas. The following description is presented to enable one of ordinary skill in the art to make and use the invention as provided in the context of a particular application and its requirements. As used herein, directional terms such as "upper", "upwards", "lower", and "downward" are intended to provide relative positions for purposes of description, and are not intended to designate an absolute frame of reference. The terms "coupled" and "connected", which are utilized herein, are defined as follows. The term "connected" is used to describe a direct connection between two circuit elements or mechanical structures, for example, by way of a metal line formed in accordance with normal integrated circuit fabrication techniques or a weld. In contrast, the term "coupled" is used to describe either a direct connection or an indirect connection between two circuit elements or mechanical structures. For example, two coupled elements may be directly connected by way of a metal line, or indirectly connected by way of an intervening circuit element (e.g., a capacitor, resistor, inductor, or by way of the source/drain terminals of a transistor). Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1B:
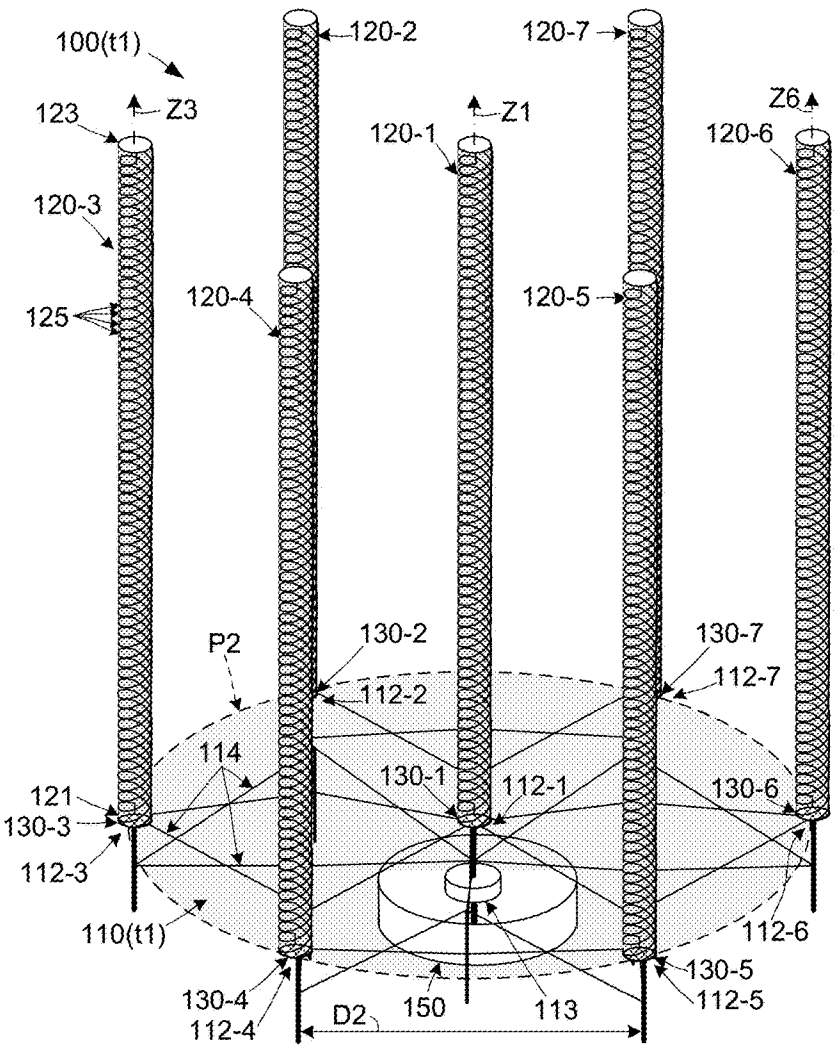
FIGS. 1(A) and 1(B) are perspective views showing a phased array antenna assembly in retracted and deployed states, respectively, according to a simplified embodiment of the present invention.
Figure 1A:
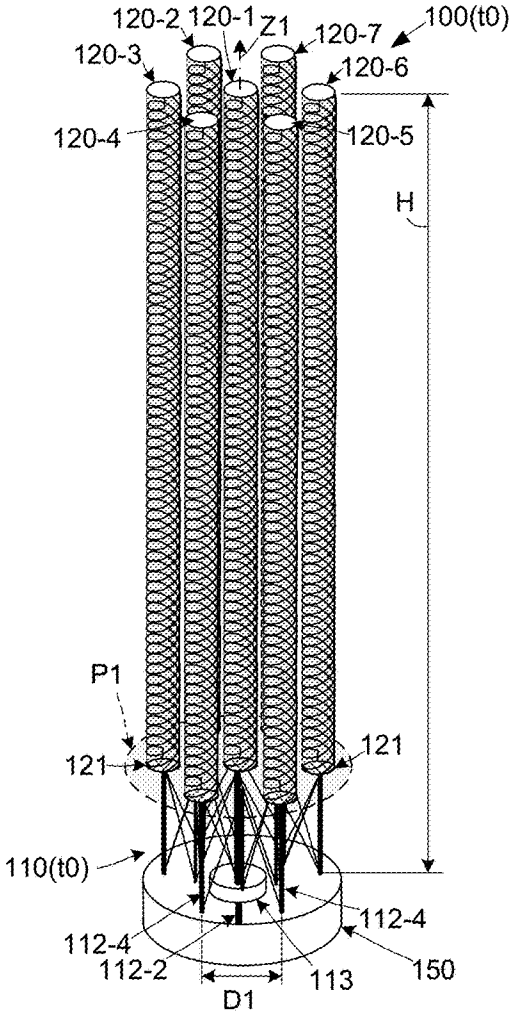

FIGS. 1(A) and 1(B) are perspective views showing a phased array antenna assembly 100 according to a simplified embodiment of the present invention. In the simplified embodiment, assembly 100 generally includes a lightweight linkage 110, an array of elongated quadrifilar helix antenna (QHA) structures 120-1 to 120-7 mechanically connected to linkage 110, and a central antenna feed circuit 150 electrically coupled to QHA structures 120-1 to 120-7 and configured such that QHA structures 120-1 to 120-7 collectively perform phased array antenna operations.

Linkage 110 includes seven support structures 112-1 to 112-7 that are operably mechanically coupled together by bar-like linkage elements 114 such that support structures 112-1 to 112-7 are rigidly maintained in a predetermined pattern. In a preferred embodiment, a central support structure 112-1 is operably mounted on a rigid base 113, and peripheral support structures 112-2 to 112-7 are disposed in a hexagonal pattern by way of intervening linkage elements 114 around central support structure 112-1. Each support structure 112-1 to 112-7 is mechanically connected to an associated QHA structure 120-1 to 120-7 such that QHA structures 120-1 to 120-7 extend in parallel directions above linkage 110, with a centrally disposed QHA structure 120-1 mounted on central support structure 112-1, and six peripheral QHA structures 120-2 to 120-7 respectively mounted on peripheral support structures 112-2 to 112-7, whereby QHA structures 120-1 to 120-7 are also maintained in a hexagonal arrangement by way of linkage 110.

In the preferred embodiment, as depicted by FIGS. 1(A) and 1(B), linkage 110 is expandable (adjustable) from a minimal-volume retracted state (stowage configuration) to a deployed state (expanded/operational configuration). Specifically, FIG. 1(A) shows linkage 110 at an initial time "t0" (indicated by "110(*t*0)") corresponding, for example, to a time period prior to and during transport of antenna assembly, for example, along with a microsatellite (not shown) by rocket or other mechanism to a deployment location (e.g., a predetermined earth orbit), and FIG. 1(B) shows linkage 110 at a subsequent time "t1" (indicated by "110(*t*1)") corresponding to a post-deployment period after a suitable deployment mechanism is remotely triggered that causes automatic reconfiguration of linkage 110 from the retracted state into the deployed state.

Referring to FIG. 1(A), when expandable linkage 110(*t*0) is in its retracted state, QHA structures 120-1 to 120-7 are maintained in parallel and in a hexagonal close-pack arrangement (closely-spaced relationship) with minimal spacing D1 between adjacent QHA structures (e.g., between adjacent QHA structures 112-4 and 112-5), whereby a size (volume) of antenna assembly 100 is optimally minimized for payload storage. In the preferred embodiment, linkage 110 is further configured such that fixed ends of QHA structures 120-1 to 120-7 (e.g., fixed end 121 of QHA structure 120-3; see FIG. 1(B)) collectively define a relatively small (first) plane P1 in the retracted state.

During subsequent deployment, the expandable linkage 110 is actuated (e.g., using force generated by a motor or spring, as described below with reference to the exemplary flexural-scissor-grid linkage) such that support structures 112-1 to 112-5 move away from each other to separation distances determined by the lengths of intervening linkage elements 114. As depicted in FIG. 1(B), when expansion of linkage 110 is complete, QHA structures 120-1 to 120-7 are positioned and rigidly subsequently maintained in a spaced-apart parallel relationship with a relatively large spacing D2 between adjacent QHA structures (e.g., between adjacent QHA structures 112-4 and 112-5) in an arrangement optimized for phased array operations. Note that, in the deployed state, the fixed ends of QHA structures 120-1 to 120-7 define a relatively large (second) plane P2 (i.e., all seven QHA structure 120-1 to 120-7 are disposed in a cylindrical volume having a length equal to the length of each QHA structure). Once the QHA structures 120-1 to 120-7 are deployed in this manner, central antenna feed circuit 150 initiates phased array operations by way of simultaneously controlling all seven of QHA structures 120-1 to 120-7 using signals passed, e.g., on separate wires (not shown) that respectively extend along linkage elements 114 from central antenna feed circuit 150 to corresponding QHA structures 120-1 to 120-7.

Referring to QHA structure 120-3 in FIG. 1(B) for reference, each QHA structure 120-1 to 120-7 of assembly 100 includes four helical filar elements 125 disposed in a spaced-apart relationship (i.e., respectively radially offset by 90°) around a central axis Z3 (i.e., such that filar elements 125 are disposed within an elongated cylindrical volume), where each of the four helical filar element 125 extends from fixed end 121 to a free end 123 of QHA structure 120-3. Note that the central axes of QHA structures 120-1 to 120-7 extend in parallel directions (i.e., central axis Z1 of QHA structure 120-1 is parallel to central axis Z3 of QHA structure 120-3 and central axis Z6 of QHA structure 120-6). The technical rationale behind engineering an QHA-based phased array antenna is three-fold: first, helix-type antennas have form factors dominated by one dimension, their long length, meaning that the gain, G, of each helical filar element 125 is mostly dependent on the length of the filars; second, a helix design yields circularly polarized waves, which is favored for robust space communications—this stems from the fact that depolarization of electromagnetic (EM) waves due to scattering and diffraction does not deteriorate the reception in circular polarization, as adversely as in linear polarization, and magnetized plasma in the ionosphere rotates the direction of linear polarization (Faraday rotation), but has no effect on circular polarization; and third, the quadrifilar variant has additional degrees of freedom, determined numerically, for tailoring the gain and bandwidth. There are several other benefits provided by QHA-based phased array antennas: first, the overall phased array antenna system is more reliable because each QHA structure is an independent operating module—if one QHA structure fails, the system performance is only degraded by a small amount (e.g., less than 2% when fifty or more QHA structures are used); second, each QHA structure can be used without a ground plane, which facilitates harnessing backfire radiation (backward mode) to yield a cardioid pattern (i.e., side lobes are smaller and the directivity is higher); and third QHA structures have relatively invariant feedpoint impedance over a wide bandwidth (i.e. approximately 60%).

Referring to FIG. 1(B), in the preferred embodiment, the four helical filar elements 125 of each QHA structure 120-1 to 120-7 is electrically coupled by way of an associated local antenna feed circuits 130-1 to 130-7 to central antenna feed circuit 150, with each local antenna feed circuit 130-1 to 130-7 disposed adjacent to the fixed end of an associated QHA structure 120-1 to 120-7 (e.g., feed circuit 130-3 is disposed adjacent to fixed end 121 of QHA structure 120-3). In one embodiment, local antenna feed circuit 130-1 to 130-7 are respectively fixedly mounted on support structures 112-1 to 112-7. During operation, central antenna feed circuit 150 transmits signals to and/or receives signals from helical filar elements 125 of QHA structures 120-1 to 120-7 in accordance with known phased array operating practices (e.g., each filar element 125 is fed with equal amplitude and phase quadrature by way of its associated local antenna feed circuit 130-1 to 130-7).

Figure 2:
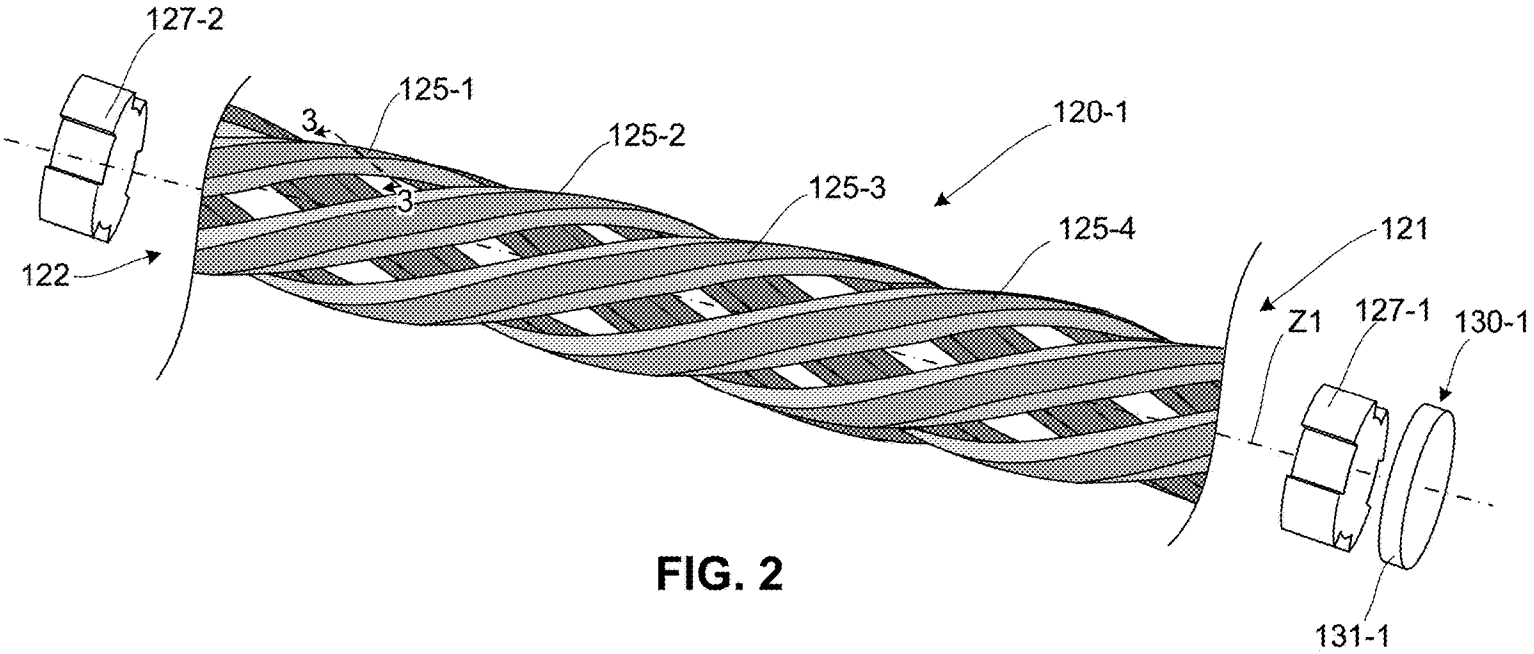
FIG. 2 is an exploded partial perspective view showing a QHA structure utilized in the assembly of FIG. 1 according to an embodiment of the present invention.

FIG. 2 is an exploded partial perspective view showing an exemplary QHA element 120-1 of assembly 100 in additional detail. QHA structure 120-1 includes four helical filar elements 125-1 to 125-4, two lightweight (e.g., plastic or polymer) spacers 127-1 and 127-2 that are respectively secured to opposite ends of helical filar elements 125-1 to 125-4, and a local circuit feed board 131-1 having local antenna feed circuit 130-1 formed thereon using known integrated circuit fabrication techniques. Spacers 127-1 and 127-2 are respectively disposed at fixed end 121 and free end 123 of QHA structure 120-1, and are configured to secure and maintain helical filar elements 125-1 to 125-4 in a spaced-apart relationship such that the helical filar elements are radially offset by common 90° distances relative to central axis Z1. Local circuit feed board 131-1 is fixedly attached to spacer 127-1 by way of connection to the support structure (not shown) to the end of each helical filar element 125-1 to 125-4 located at fixed end 121.

Figure 3C:
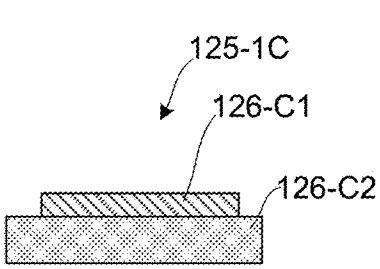
FIGS. 3(A), 3(B) and 3(C) are cross-sectional views taken along section line 3-3 of FIG. 2, and show modified helical filar elements utilized by the QHA structure of FIG. 2 according to alternative exemplary embodiments.
Figure 3B:
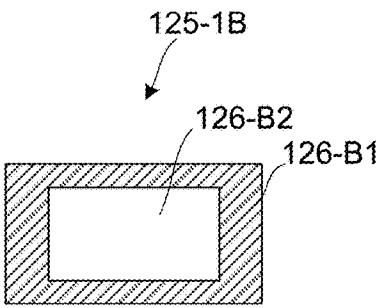
Figure 3A:
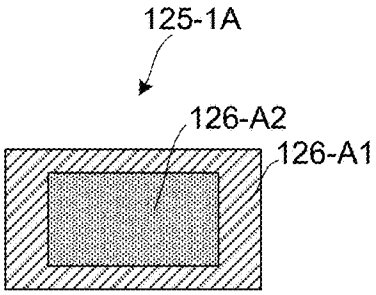

FIGS. 3(A) to 3(C) are cross-sectional views taken along section line 3-3 of FIG. 2, and show filar element 125-1 of QHA 120 as constructed using three exemplary alternative modified filar element structures. According to a presently preferred embodiment, helical filar elements 125-1 to 125-4 of QHA structure 120-1 are modified to minimize the overall weight of assembly 100. That is, in contrast to conventional helical filar elements that comprise solid metal wires, each helical filar elements 125-1 to 125-4 of QHA structure 120-1 (and those of all remaining QHA structures 120-2 to 120-7 of assembly 100) are fabricated using one or more techniques that minimize weight while maintaining optimal phased array performance. FIG. 3(A) shows a first specific embodiment in which a helical filar element 125-1A includes a conductive material 126-A1 plated or otherwise conformally disposed on a lightweight core (e.g., a liquid crystal polymer or other polymer) 126-A2. FIG. 3(B) shows a second specific embodiment in which a helical filar element 125-1B includes a thin-walled metal (e.g., aluminum) tube 126-B1 surrounding and air-filled or vacuum-filled void 126-B2. FIG. 3(C) shows a third specific embodiment in which a helical filar element 125-1C includes a conductive material 126-C1 that has been printed or otherwise disposed on a flexible (e.g., plastic or polymer) substrate 126-C2. In each embodiment, the element structure is bent into the required helical configuration, and then secured in the radially offset, spaced-apart arrangement shown in FIG. 2 by way of spacers 127-1 and 127-2.

Figure 4:
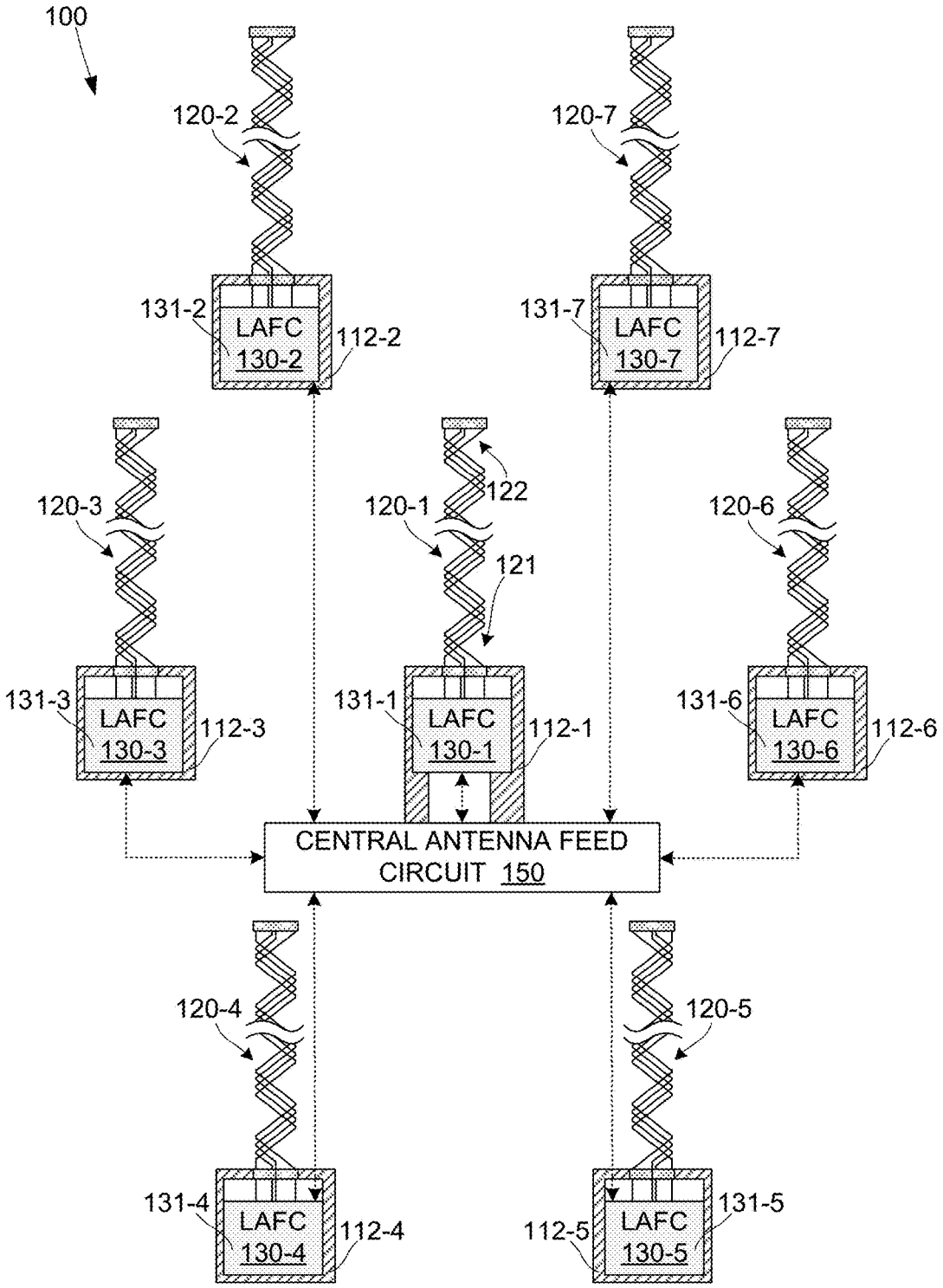
FIG. 4 is a simplified diagram depicting generalized electrical and mechanical couplings between a central antenna feed circuit and the various QHA structures of the assembly of FIG. 1 according to an embodiment of the present invention.

FIG. 4 is a simplified diagram depicting generalized electrical and mechanical couplings between central antenna feed circuit 150 and QHA structures 120-1 to 120-7 of assembly 100. As mentioned above, QHA structures 120-1 to 120-7 are respectively fixedly connected at their fixed ends to support structures 112-1 to 112-7, with local antenna feed boards 131-1 to 131-7 also fixedly connected to support structures 112-1 to 112-7, respectively. In this example, central antenna feed circuit 150 is connected to support structure 112-1. As indicated by the dashed-line arrows, central antenna feed circuit 150 is electrically coupled to each QHA structure 120-1 to 120-7 by way of local feed circuits 130-1 to 130-7, respectively.

Figure 5:
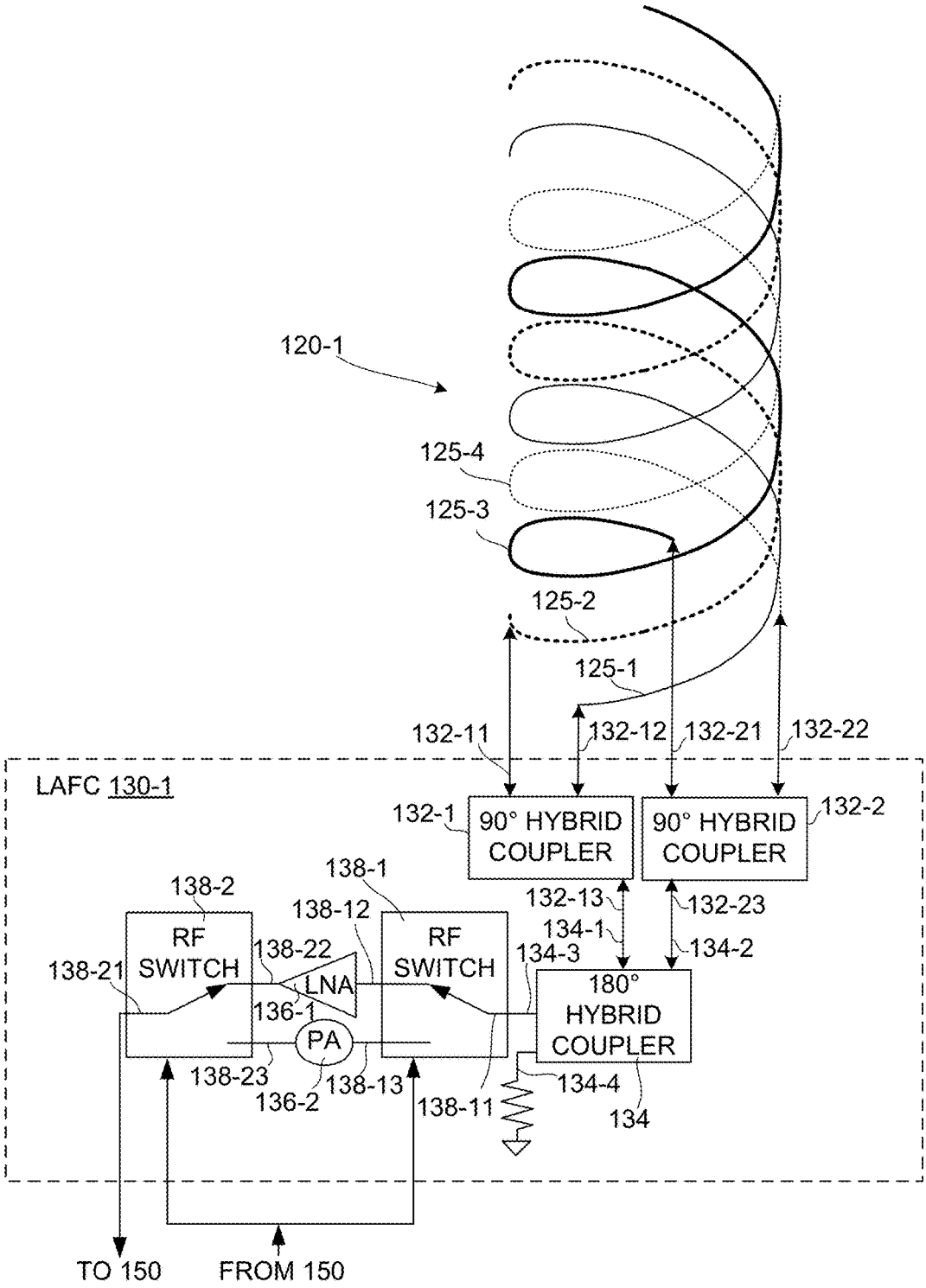
FIG. 5 is a simplified circuit diagram showing an exemplary local antenna feed circuit utilized by each QHA of the assembly of FIG. 1 according to an exemplary embodiment of the present invention.

FIG. 5 is a simplified circuit diagram showing local antenna feed circuit (LAFC) 130-1 according to an exemplary embodiment of the present invention. For clarity and descriptive purposes, portions of helical filar elements 125-1 to 125-4 are depicted using different (thick/thin/solid/dashed) lines above LAFC 130-1. LAFC 130-1 generally includes two (first and second) 90° hybrid couplers 132-1 and 132-2, a 180° (third) hybrid coupler 134, two amplifiers 136-1 and 136-2, and two RF switches 138-1 and 138-2. 90° hybrid couplers 132-1 and 132-2 are configured to generate the four-quadrature phases, and 180° hybrid coupler 134 is configured to generate out-of-phase outputs that feed 90° hybrid couplers to produce all four phases. Specifically, first 90° hybrid coupler 132-1 has a first terminal 132-11 connected to helical filar element 125-1, a second terminal 132-12 connected to helical filar element 125-2, and a third terminal 132-23 connected to a first terminal 134-1 of 180° hybrid coupler 134. Second 90° hybrid coupler 132-2 has a first terminal 132-21 connected to helical filar element 125-3, a second terminal 132-22 connected to helical filar element 125-4, and a third terminal 132-23 connected to a second terminal 134-2 of 180° hybrid coupler 134. 180° hybrid coupler 134 has a third terminal 134-3 connected to a first terminal 138-11 of first RF switch 138-1 and a fourth terminal 134-4 connected to a ground potential provided by central antenna feed circuit 150 (not shown), for example, by way of a coaxial cable. RF switches 138-1/2 are configured to operably couple amplifier 136-1 between central antenna feed circuit 150 and 180° hybrid coupler 134 during each receive mode operating phase of the phased array antenna operation, and configured to couple amplifier 136-2 between central antenna feed circuit 150 and 180° hybrid coupler 134 during each transmit mode operating phase of the phased array antenna operation. Specifically, first RF switch 138-1 is controlled by way of a control signal received from central antenna feed circuit 150 to connect first input terminal 138-11 to either first amplifier 136-1 by way of a second terminal 138-12 or second amplifier 136-2 by way of a third terminal 138-13, and second RF switch 138 has a first terminal 138-21 coupled to central antenna feed circuit 150, and is controlled by way of a control signal to connect first input terminal 138-21 to either first amplifier 136-1 by way of a second terminal 138-22 or second amplifier 136-2 by way of a third terminal 138-23. In one embodiment, first amplifier 136-1 is a low-noise amplifier having an input terminal connected to second terminal 138-12 of RF switch 138-1, and an output terminal connected to second terminal 138-22 of RF switch 138-2, and second amplifier 136-2 is a power amplifier having an output terminal connected to terminal 138-13 of RF switch 138-1, and an input terminal connected to terminal 138-23 of RF switch 138-2. This arrangement provides a radar component for driving each QHA structure in which high speed RF switches 138-1 and 138-2 toggle between transmit and receive modes. In one embodiment, low-noise amplifier 136-1 is implemented using a high quality low noise amplifier (e.g., a Silicon-Germanium Monolithic Microwave Integrated Circuit (SiGe MMIC) amplifier) to achieve a noise figure of 1.6 dB. Similarly, on the transmit pathway, power amplifier 136-2 is implemented using a Gallium-Nitride High Electron Mobility Transistor (GaN HEMI) amplifier. In alternative embodiments that perform only transmit or only receive functions, one of amplifiers 136-1 and 136-2 and one or both RF switches 138-1 and 138-2 may be omitted.

Figure 6A:
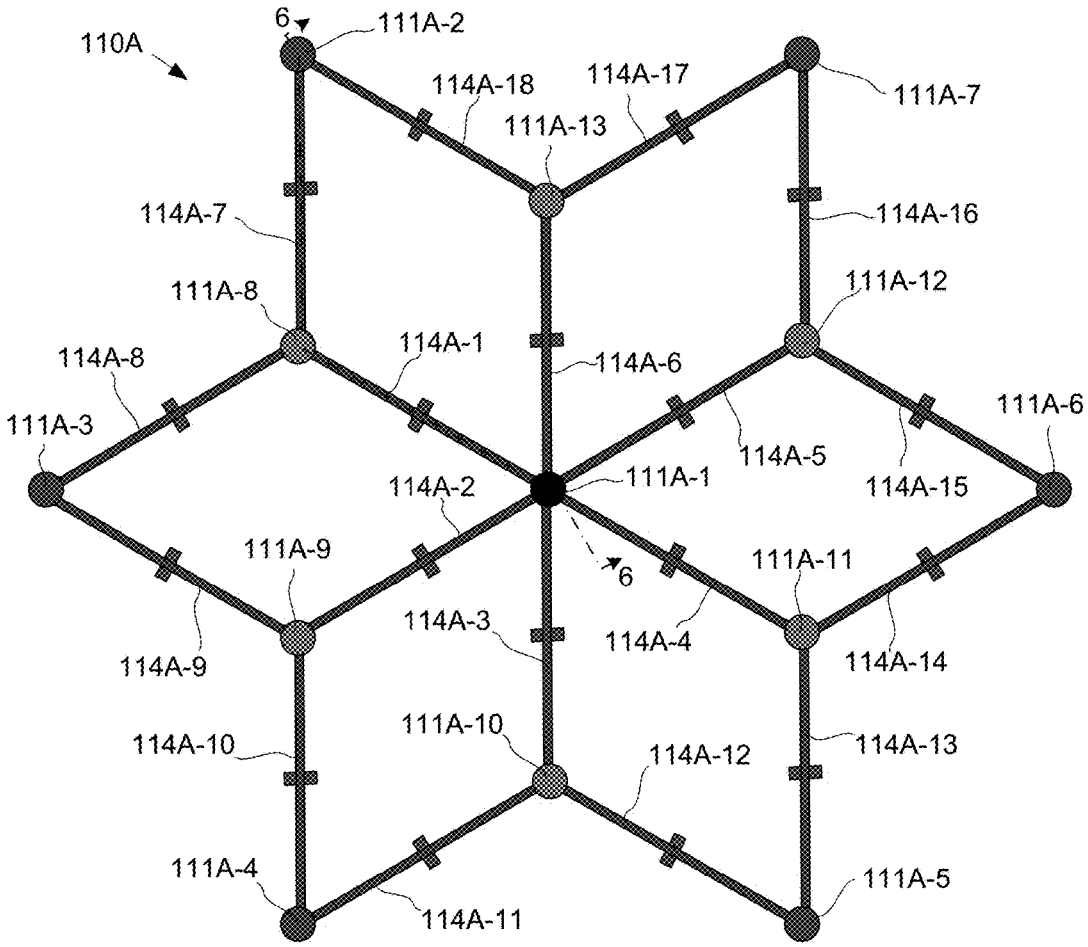
FIGS. 6(A) and 6(B) are top and partial cross-sectional side views showing a flexure-scissor-grid (expandable) linkage utilized by the assembly of FIG. 1 according to another exemplary embodiment of the present invention.
Figure 6B:
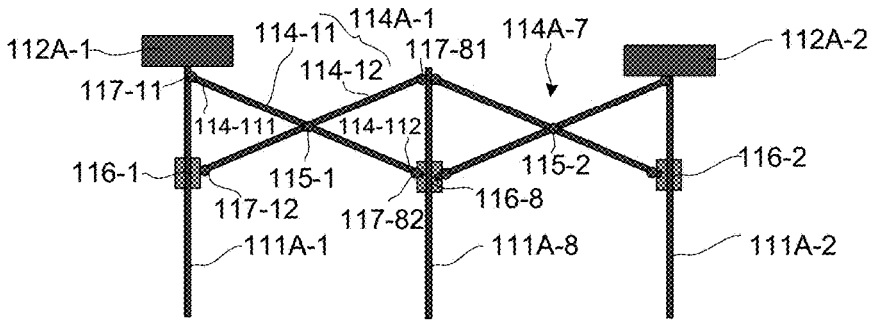

FIGS. 6(A) and 6(B) are top and partial cross-sectional side views showing a flexure-scissor-grid (expandable) linkage 110A according to another exemplary embodiment. Linkage 110A generally includes thirteen parallel slide rods 111A-1 to 111A-13 (shown in end view in FIG. 6(A)) that are operably expandably coupled by way of eighteen scissor units 114A-1 to 114A-18. Referring briefly to FIG. 6(B), each slide rod (e.g., slide rod 111A-1) is a vertically oriented elongated rigid member, and each scissor unit (e.g., scissor unit 114-A-1) includes two (first and second) bars 114-11 and 114-12 that are rotatably connected together at an intermediate points by a pivot hinge 115-1, with each bar 114-11 and 114-12 pivotably (i.e., non-slidably) attached (e.g., by way of pivot hinge 117-11) at its upper end 114-111 to one associated slide rod (e.g., slide rod 111A-1), and pivotably and slidably attached (e.g., by way of a slide bearing 116-8) at its lower end 114-112 to an adjacent second associated slide rod (e.g., slide rod 111-8). Referring again to FIG. 6(A), parallel slide rods 111A-1 to 111A-13 include a central slide rod 111A-1, six peripheral slide rods 111A-2 to 111A-7 disposed in a hexagonal pattern around central slide rod 111A-1, and six intermediate slide rods 111A-8 to 111A-13 disposed in a hexagonal pattern between central slide rod 111A-1 and peripheral slide rods 111A-2 to 111A-7. QHA support structures (discussed above) are disposed at the top of central slide rod 111A-1 and peripheral slide rods 111A-2 to 111A-7, but are not disposed on intermediate slide rods 111A-8 to 111A-13. For example, referring to FIG. 6(B), support structure 112A-1 is fixedly connected to the upper end of support rod 111A-1, and support structure 112A-2 is fixedly connected to the upper end of support rod 111A-2, but no support structure is provided on intermediate slide rod 111A-8, whereby QHA structures (not shown) are mounted onto support rods 111A-1 and 111A-2, but not onto intermediate slide rod 111A-8. Scissor units 114-1 to 114-18 include six primary scissor units 114-1 to 114-6 respectively coupled between central slide rod 111-1 and intermediate slide rods 111-8 to 111-13, and twelve secondary scissor units 114-7 to 114-18 coupled between associated intermediate slide rods 111-8 to 111-13 and peripheral slide rods 111A-2 to 111A-7. For example, secondary scissor unit 114-7 is coupled between associated intermediate slide rod 111-8 and associated peripheral slide rod 111A-2.

Figure 7A:
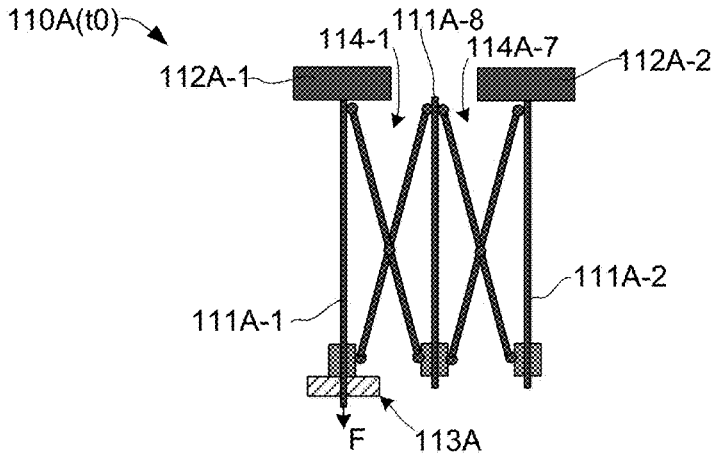
FIGS. 7(A), 7(B) and 7(C) are cross-sectional side views showing a portion of the expandable linkage of FIGS. 6(A) and 6(B) during operation.
Figure 7B:
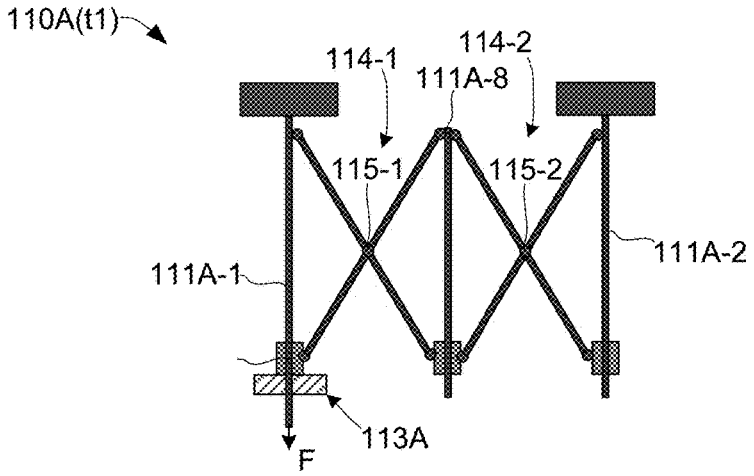
Figure 7C:
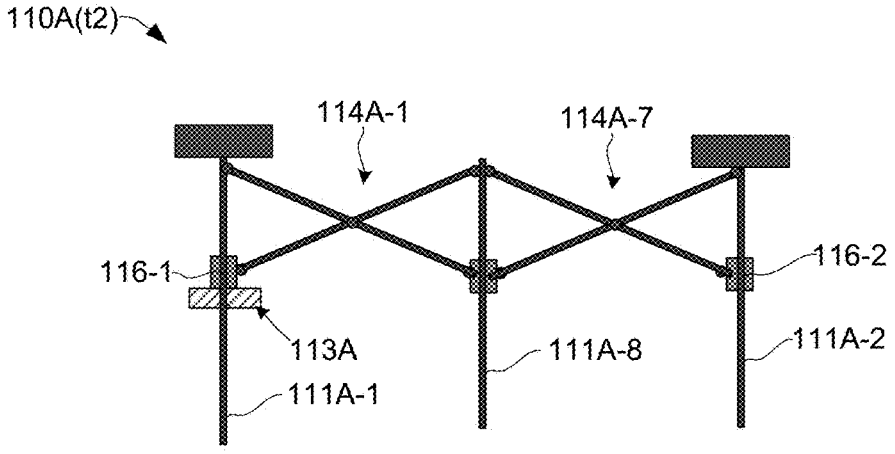

FIGS. 7(A) to 7(C) are cross-sectional side views showing a portion of linkage 110A during operation. FIG. 7(A) shows linkage 110A at a time t0 in an exemplary retracted state, FIG. 7(C) shows linkage 110A at a time t2 in a fully deployed state, and FIG. 7(B) shows linkage 110A at a time t1 (i.e., between times t0 and t2) during expansion from the retracted state to the deployed state. Referring to FIG. 7(A), deployment is generally achieved by "closing" scissor units 114-1 to 114-13, which causes slide rods 111A-2 to 111A-13 to move outward away from central slide rod 111A-1. In particular, deployment is achieved by applying a downward force F on central slide rod 111A-1 while preventing downward movement of the lower ends of six primary scissor units (e.g., by utilizing fixed, rigid base 113 to resist downward movement of slide bearing 116-1), thereby effectively biasing lower ends of the six primary (innermost) scissor unit (e.g., scissor unit 114A-1) upward along the central slide rod 111A-1. As depicted in FIG. 7(B), the resulting outward movement of the intermediate slide rods (e.g., slide rod 111A-8 to 111-13 away from central slide rod 111A-1 causes the secondary scissor units (e.g., scissor unit 114-7) to substantially simultaneously pivot toward the closed position, causing the six peripheral slide rods (e.g., slide rod 111-2) to also move radially outward from the central slide rod 111-1 while maintaining the six peripheral MHA structures (not shown) in the desired coplanar, hexagonal pattern relative to the central MHA structure.

Figure 8A:
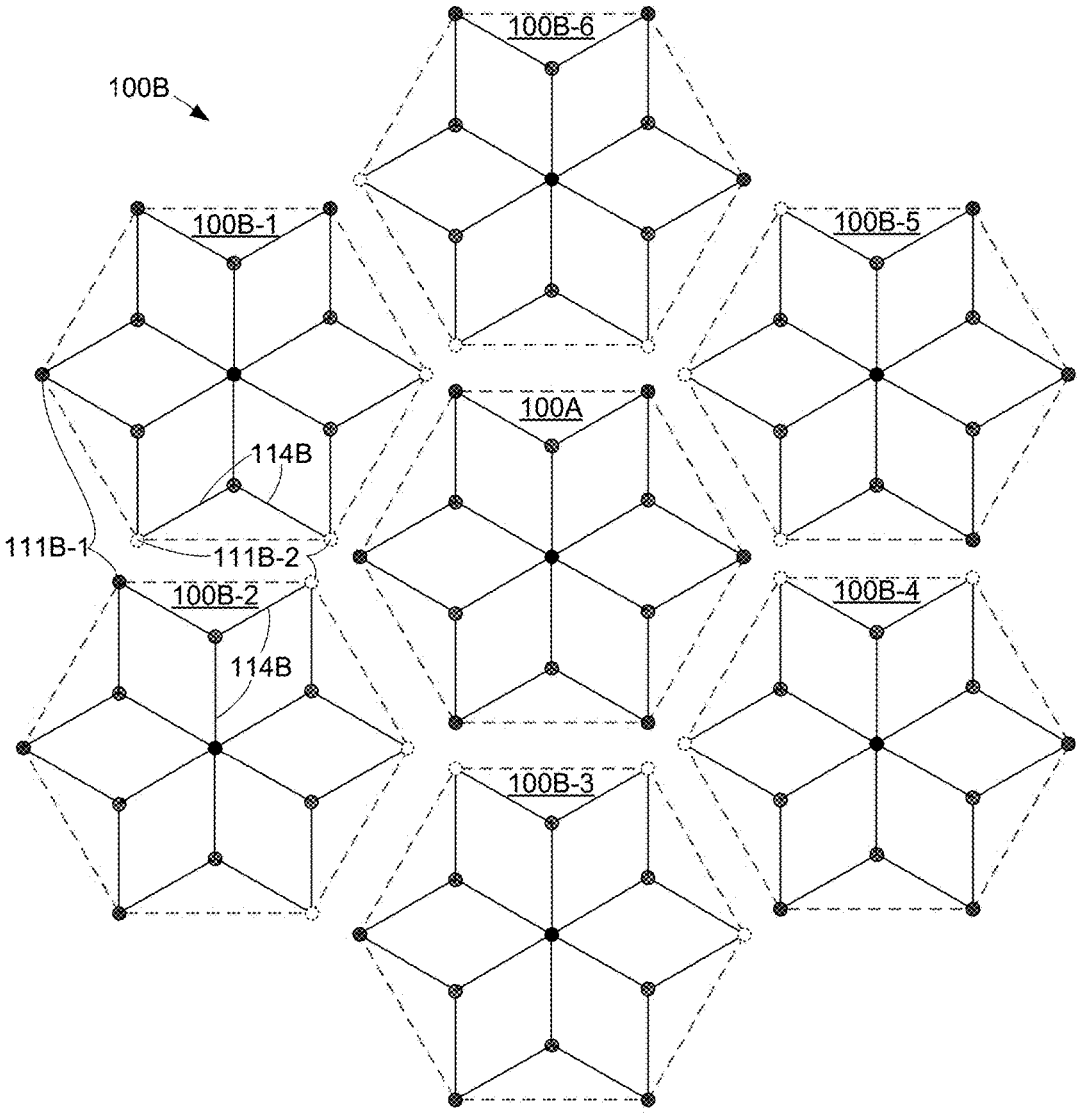
FIGS. 8(A) and 8(B) are exploded and assembled top views showing a simplified flexure-scissor-grid linkage according to another exemplary embodiment of the present invention.
Figure 8B:
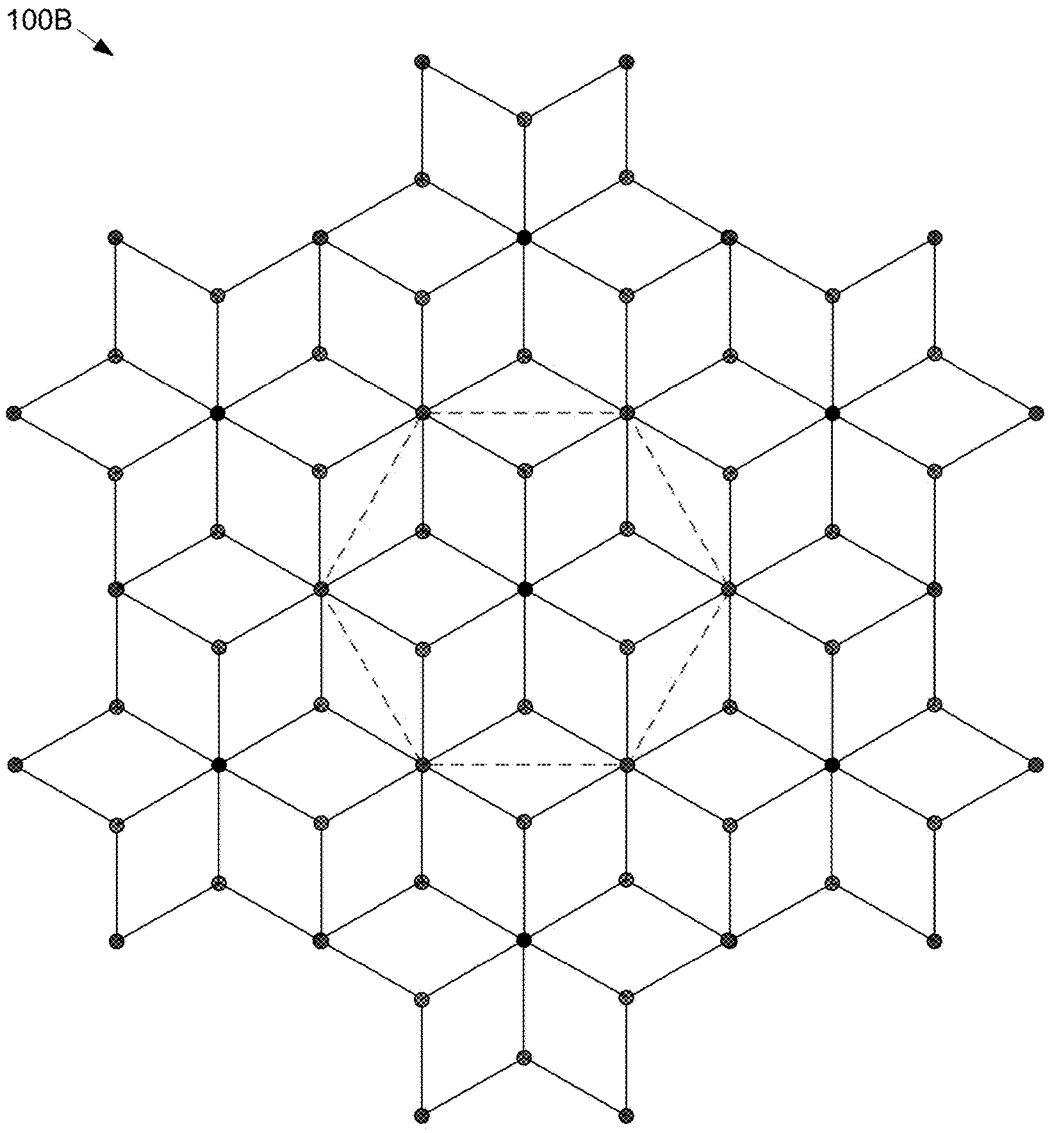

FIGS. 8(A) and 8(B) illustrate a second simplified flexure-scissor-grid linkage according to another exemplary embodiment of the present invention. As demonstrated by FIGS. 8(A) and 8(B), another benefit of linkage 110A is that the core arrangement is easily expanded to facilitate the production of deployable phased array antenna assemblies having any number of QHA structures while maintaining the high compaction ratio and simplified deployment mechanism described above. That is, FIG. 8(A) depicts the formation of a 31-QHA linkage 110B including a centrally located "core" linkage 110A that is configured and operates as described above with reference to FIGS. 6(A) to 7(C). FIG. 8(A) also depicts six additional linkages 110B-1 to 110B-6 disposed around "core" linkage 110A, where each additional linkages 110B-1 to 110B-6 is substantially identical to linkage 110A. As depicted by the double-headed arrows extending between "core" linkage 110A and additional linkages 110B-1 to 110B-6 in FIG. 8(A), the simplified flexure-scissor-grid linkage arrangement described herein facilitates relatively simplified scaling of antenna assemblies to provide an increased number of peripheral slide rods 111B-1 (and, hence, an increased number of QHA structures supported by linkage 100B) by way of coupling the additional slide rods to the "core" linkage 110A using additional scissor units 114B. Note that additional linkages 110B-1 to 110B-6 only differ from "core" linkage 110A in that redundant slide rods (indicated by dashed-line circles 111B-2 in FIG. 8(A)) are omitted. FIG. 8(B) shows the completed 31-QHA linkage 110B. Using similar techniques, phased array antennas having any number of QHA structures (e.g., 55 or 115) are easily produced in accordance with the present invention.

A comparison between state-of-the-art aperture deployable antenna designs and a QHA-based phased array antenna assembly having 115 QHA structures and produced in accordance with the present invention is provided in Table 1 (below). The performance specs associated with the QHA-based antenna assembly are derived from rigorous EM simulations using commercial EM solvers.

TABLE 1

Comparison of conventional deployable antennas with a phased array antenna assembly of the present invention.

| Conventional Antenna Approaches | Physical Antenna Area | Freq. | Gain (dBi) | Antenna Efficiency |
|---|---|---|---|---|
| Large reflector | 78 $m^2$ | 1.6 GHz | 37.2 | 29% |
| antenna | | 5.0 GHz | 47.3 | 35% |
| Inflatable reflector | ~1 $m^2$ | 8.3 GHz | 33.7 | 37% |
| Waveguide array | 4.32 $m^2$ | 1.43 GHz | 23 | 40% |

TABLE 1-continued

Comparison of conventional deployable antennas with a phased array antenna assembly of the present invention.

| Conventional Antenna Approaches | Physical Antenna Area | Freq. | Gain (dBi) | Antenna Efficiency |
|---|---|---|---|---|
| Inflatable passive array with 96 | 3.3 $m^2$ | 1.25 | 26.7 | 74% |
| Phased Array Antenna Assembly | 2.89 $m^2$ | 5.6 | 43.4 | 92% |

Table 1 demonstrates that QHA-based phased array antenna assemblies produced in accordance with the present invention possess the highest combination of gain and antenna efficiency as compared to other competing deployable antenna technologies. The efficiency is higher, compared to other approaches, not only because of the scheme employed, but also because this design approach eliminates many of the factors that degrade a dish reflector such as feed illumination mismatch, aperture taper, cross polarization, aperture blockage, and non-single feed point. The performance, exhibited by the QHA-based phased array is sufficient to provide the required equivalent isotropically radiated power (EIRP) levels (~50 dbW) required to fulfill the link requirements, without the need for high power transmitters that are incompatible with microsatellite designs. From the standpoint of physical size, antenna gain and antenna efficiency, antenna assemblies produced in accordance with the present invention clearly exceed the performance of the state-of-the-art deployable antennas.

Although the present invention has been described with respect to certain specific embodiments, it will be clear to those skilled in the art that the inventive features of the present invention are applicable to other embodiments as well, all of which are intended to fall within the scope of the present invention. According to one possible alternative embodiment, multifilar helical antenna (MHA) structures having any number of helical filar elements may be utilized in place of the QHA structures described above. For example, hexifilar helical antenna structures having six helical filar elements radially spaced 60° apart, or octofilar helical antenna structures having eight filar elements radially spaced 45° apart may be utilized in place of the QHAs to increase gain and improve the compaction ratio.

The invention claimed is:

1. A phased array antenna assembly comprising:

a flexure-scissor-grid linkage including a plurality of support structures mechanically coupled by a plurality of linkage elements;

a plurality of multifilar helix antenna (MHA) structures, each said MHA structure having a fixed end connected to an associated support structure of the plurality of support structures and including a plurality of helical filar elements disposed in a spaced-apart relationship around a central axis and extending from said fixed end to a free end of said each MHA structure, wherein said plurality of MHA structures extend in parallel directions from said linkage, and a central antenna feed circuit configured to simultaneously control all of said plurality of MHA structures such that said plurality of MHA structures collectively perform a phased array antenna operation.

2. The phased array antenna assembly of claim 1, wherein each said helical filar element comprises one of:

a conductive material disposed on a polymer core, wherein the polymer core is bent into a helical shape;

a thin-walled metal tube bent into a helical shape, and a conductive material disposed on a flexible substrate, wherein the substrate is bent into a helical shape.

3. The phased array antenna assembly of claim 2, wherein each MHA structure further comprises:

first and second spacers comprising polymer/plastic and respectively disposed at the fixed and free ends and configured to secure corresponding end portions of said multiple helical filar elements in said spaced-apart relationship such that each adjacent pair of said multiple helical filar elements is offset by a common radial distance relative to the central axis; and a local feed circuit board fixedly attached to the first spacer and electrically coupled between each of said helical filar elements and said central antenna feed circuit.

4. The phased array antenna assembly of claim 3, wherein each said MHA structure of said plurality of MHA structures comprises one of a quadrifilar structure including four helical filar elements, a hexifilar structure including six helical filar elements, and an octofilar structure including eight helical filar elements.

5. The phased array antenna assembly of claim 1, further comprising a plurality of local antenna feed circuits, each local antenna feed circuit disposed adjacent to the fixed end of an associated said MHA structure and electrically coupled between said central antenna feed circuit and said plurality of helical filar elements of said associated MHA structure.

6. The phased array antenna assembly of claim 5, wherein each local antenna feed circuit comprises:

a first hybrid coupler having first and second terminals respectively connected to a first helical filar element and a second filar element of said plurality of helical filar elements;

a second hybrid coupler having first and second terminals respectively connected to a third filar element and a fourth filar element of said plurality of helical filar elements;

a third hybrid coupler having first and second terminals respectively connected to third terminal of said first and second hybrid couplers; and at least one amplifier coupled between said central antenna feed circuit and an output port of said third hybrid coupler.

7. The phased array antenna assembly of claim 6, wherein said at least one amplifier comprises a low-noise amplifier and a power amplifier, and wherein said each local antenna feed circuit further comprises:

a first switch having a first terminal connected to a third terminal of said third hybrid coupler, a second terminal connected to an input terminal of said low-noise amplifier, and a third terminal connected to an output terminal of said power amplifier, and a second switch having a first terminal coupled to the central antenna feed circuit, a second terminal connected to an output terminal of said low-noise amplifier, and a third terminal connected to an input terminal of said power amplifier, and wherein said first and second switches are configured to operably couple said low-noise amplifier between said central antenna feed circuit and said third hybrid coupler during each receive mode operating phase of said phased array antenna operation, and configured to couple said power amplifier between said central antenna feed circuit and said third hybrid coupler during each transmit mode operating phase of said phased array antenna operation.

8. The phased array antenna assembly of claim 1, wherein said plurality of MHA structures comprise a centrally disposed first MHA structure and six peripheral MHA structures disposed in a hexagonal pattern around said first MHA structure and mechanically coupled to the first MHA structure by a plurality of first linkage elements.

9. The phased array antenna assembly of claim 8, further comprising one or more additional MHA structures disposed peripheral to said six peripheral MHA structures and mechanically coupled to said six peripheral MHA structures by a plurality of second linkage elements.

10. The phased array antenna assembly of claim 1, wherein the linkage comprises an expandable linkage configured to adjust from a retracted state to a deployed state, wherein when said expandable linkage is in said retracted state, each adjacent pair of said support structures is separated by a first distance such that said plurality of MHA structures are maintained in a closely-spaced relationship, wherein when said expandable linkage is in said deployed state, each adjacent pair of said support structures are separated by a second distance greater than said first distance such that said plurality of MHA structures are maintained in a spaced-apart relationship, and wherein the central antenna feed circuit configured to simultaneously control all of said plurality of MHA structures such that said plurality of MHA structures collectively perform a phased array antenna operation only when said expandable linkage is in said deployed state.

11. The phased array antenna assembly of claim 10, wherein said expandable linkage is further configured such that said fixed ends of said plurality of MHA structures define a first plane when said expandable linkage is in said retracted state, and such that said fixed ends of said plurality of MHA structures define a second plane when said expandable linkage is in said deployed state.

12. The phased array antenna assembly of claim 11, wherein said expandable linkage further comprises:

a plurality of parallel slide rods including a central slide rod connected to a first support structure of said plurality of support structures, six peripheral slide rods connected to six peripheral support structures of said plurality of support structures and disposed in a hexagonal pattern around said central slide rod, and six intermediate slide rods disposed between said central slide rod and said six peripheral slide rods; and a plurality of scissor units, each said scissor unit includes first and second bars rotatably connected at intermediate points by a pivot hinge, each of said first and second bars being pivotably attached at a first end to a first associated slide rod of said plurality of parallel slide rods, and each of said first and second bars being pivotably and slidably attached at a second end to a second associated slide rod of said plurality of parallel slide rods, wherein said plurality of scissor units includes:

six primary scissor units respectively coupled between the central slide rod and the six intermediate slide rods; and twelve secondary scissor units, each secondary scissor unit coupled between an associated intermediate slide rod of the six intermediate slide rods and an associated peripheral slide rod of said six peripheral slide rods.

13. The phased array antenna assembly of claim 12, wherein said expandable linkage further comprises one or more additional slide rods coupled by way of one or more additional scissor units to one of said six peripheral slide rods.

14. A deployable phased array antenna assembly comprising:

an expandable linkage including a plurality of support structures connected by a plurality of linkage elements, wherein the expandable linkage is configured to adjust from a retracted state to an deployed state, a plurality of multifilar helix antenna (MHA) structures, each said MHA structure having a fixed end connected to an associated support structure of the plurality of support structures and including a plurality of helical filar elements disposed in a spaced-apart relationship around a central axis and extending from said fixed end to a free end of said each MHA structure; and a central antenna feed circuit configured to simultaneously control all of said plurality of MHA structures such that said plurality of MHA structures collectively perform a phased array antenna operation when said expandable linkage is in said deployed state, wherein when said expandable linkage is in said retracted state, each adjacent pair of said support structures is separated by a first distance such that said plurality of MHA structures are maintained in a closely-spaced relationship, and wherein when said expandable linkage is in said deployed state, said each adjacent pair of said support structures are separated by a second distance greater than said first distance such that said plurality of MHA structures are maintained in a spaced-apart relationship.

15. The phased array antenna assembly of claim 14, wherein each said helical filar element comprises:

a conductive material disposed on a polymer core, wherein the polymer core is bent into a helical shape;

a thin-walled metal tube bent into a helical shape, and a conductive material disposed on a flexible substrate, wherein the substrate is bent into a helical shape.

16. The phased array antenna assembly of claim 15, wherein each MHA structure further comprises:

first and second spacers comprising polymer/plastic and respectively disposed at the fixed and free ends and configured to secure corresponding end portions of said multiple helical filar elements in said spaced-apart relationship such that each adjacent pair of said multiple helical filar elements is offset by a common radial distance relative to the central axis; and a local feed circuit board fixedly attached to the first spacer and electrically coupled between each of said helical filar elements and said central antenna feed circuit.

17. The phased array antenna assembly of claim 14, further comprising a plurality of local antenna feed circuits, each local antenna feed circuit disposed adjacent to the fixed end of an associated said MHA structure and electrically coupled between said central antenna feed circuit and said plurality of helical filar elements of said associated MHA structure.

18. The phased array antenna assembly of claim 17, wherein each local antenna feed circuit comprises:

a first hybrid coupler having first and second terminals respectively connected to a first helical filar element and a second filar element of said plurality of helical filar elements;

a second hybrid coupler having first and second terminals respectively connected to a third filar element and a fourth filar element of said plurality of helical filar elements;

a third hybrid coupler having first and second terminals respectively connected to third terminal of said first and second hybrid couplers; and at least one amplifier coupled between said central antenna feed circuit and an output port of said third hybrid coupler.

19. The phased array antenna assembly of claim 18, wherein said at least one amplifier comprises a low-noise amplifier and a power amplifier, and wherein said each local antenna feed circuit further comprises:

a first switch having a first terminal connected to a third terminal of said third hybrid coupler, a second terminal connected to an input terminal of said low-noise amplifier, and a third terminal connected to an output terminal of said power amplifier, and a second switch having a first terminal coupled to the central antenna feed circuit, a second terminal connected to an output terminal of said low-noise amplifier, and a third terminal connected to an input terminal of said power amplifier, and wherein said first and second switches are configured to operably couple said low-noise amplifier between said central antenna feed circuit and said third hybrid coupler during each receive mode operating phase of said phased array antenna operation, and configured to couple said power amplifier between said central antenna feed circuit and said third hybrid coupler during each transmit mode operating phase of said phased array antenna operation.

20. A method for deploying and operating a phased array antenna assembly comprising:

disposing a plurality of multifilar helix antenna (MHA) structures on an expandable linkage such that a fixed end of each said MHA structure is connected to an associated support structure of said expandable linkage, wherein each said MHA structure includes a plurality of helical filar elements disposed in a spaced-apart relationship around a central axis and extending from said fixed end to a free end of said each MHA structure;

configuring the expandable linkage into a retracted state such that each adjacent pair of said support structures is separated by a first distance, whereby said plurality of MHA structures are maintained in a closely-spaced relationship;

transporting said phased array antenna assembly to a deployment location while disposed in said retracted state;

automatically reconfiguring the expandable linkage into a deployed state such that said each adjacent pair of said support structures are separated by a second distance greater than said first distance, whereby said plurality of MHA structures are maintained in a spaced-apart relationship; and utilizing a central antenna feed circuit to simultaneously control all of said plurality of MHA structures while said expandable linkage is in said deployed state such that said plurality of MHA structures collectively perform a phased array antenna operation.

* * * * *